US009974346B2

(12) United States Patent
Beneyto-Ferre

(10) Patent No.: US 9,974,346 B2
(45) Date of Patent: May 22, 2018

(54) GARMENT, ESPECIALLY SPORTS GARMENT

(71) Applicant: PUMA SE, Herzogenaurach (DE)

(72) Inventor: Jordi Beneyto-Ferre, Nuernberg (DE)

(73) Assignee: PUMA SE, Herzogenaurach (DE)

( * ) Notice: Subject to any disclaimer, the term of this patent is extended or adjusted under 35 U.S.C. 154(b) by 0 days. days.

(21) Appl. No.: 14/892,493

(22) PCT Filed: Mar. 1, 2014

(86) PCT No.: PCT/EP2014/000533

§ 371 (c)(1),
(2) Date: Nov. 19, 2015

(87) PCT Pub. No.: WO2015/131913

PCT Pub. Date: Sep. 11, 2015

(65) Prior Publication Data

US 2016/0302502 A1 Oct. 20, 2016

(51) Int. Cl.

| | |
|---|---|
| ***A41D 27/28*** | (2006.01) |
| ***A41B 1/08*** | (2006.01) |
| ***A41D 3/00*** | (2006.01) |
| ***A41D 13/00*** | (2006.01) |

(52) U.S. Cl.

CPC ..... *A41D 27/285* (2013.01); *A41B 1/08* (2013.01); *A41D 3/00* (2013.01); *A41D 13/0015* (2013.01)

(58) Field of Classification Search

CPC .... A41D 27/285; A41D 3/00; A41D 13/0015; A41D 27/28; A41B 1/08; Y10S 2/01

USPC ..... 2/93

See application file for complete search history.

(56) References Cited

U.S. PATENT DOCUMENTS

| | | | | | |
|---|---|---|---|---|---|
| 317,711 | A | * | 5/1885 | Brinkmann | A41D 27/28 2/118 |
| 2,079,980 | A | * | 5/1937 | Anders | A41D 27/28 2/105 |
| 2,084,173 | A | * | 6/1937 | Wexler | A41D 27/28 2/87 |
| 2,771,661 | A | * | 11/1956 | Foster | A41D 31/02 2/87 |
| 3,045,243 | A | * | 7/1962 | Lash | A41D 27/28 2/1 |
| 3,086,215 | A | * | 4/1963 | Di Paola | A41D 27/28 2/87 |

(Continued)

FOREIGN PATENT DOCUMENTS

| | | | |
|---|---|---|---|
| DE | 19626046 | A1 | 1/1998 |
| DE | 10261359 | A1 | 7/2004 |
| WO | 2012058721 | A1 | 5/2012 |

*Primary Examiner* — Richale Quinn
*Assistant Examiner* — Anne Kozak
(74) *Attorney, Agent, or Firm* — Lucas & Mercanti, LLP

(57) ABSTRACT

A garment, especially a sports garment, having a section which at least partially covers the body of a wearer, wherein the section has at least one venting element for allowing an air flow to flow from the outside of the garment through the section into the inner of the garment for cooling a part of the body of the wearer. To improve the cooling during the movement of the wearer of the garment an actuating mechanism is arranged for opening and closing the venting element in dependence of the movement of a part of the body of the wearer during the use of the garment.

10 Claims, 3 Drawing Sheets

(56) References Cited

U.S. PATENT DOCUMENTS 3,153,793 A * 10/1964 Lepore ..... A41D 3/00 2/108
3,213,465 A * 10/1965 Ludwikowski ..... A41D 27/28 2/237
3,369,303 A * 2/1968 Henry ..... D06J 1/00 112/146
3,761,962 A * 10/1973 Myers ..... A41D 27/28 2/227
3,950,789 A * 4/1976 Konz ..... A41D 13/0055 2/250
4,408,356 A * 10/1983 Abrams ..... A41D 27/28 2/87
4,451,934 A * 6/1984 Gioello ..... A41B 9/00 2/113
4,608,715 A * 9/1986 Miller ..... A41D 27/285 2/1
4,722,099 A * 2/1988 Kratz ..... A41D 27/28 2/115
4,731,883 A * 3/1988 Foster ..... A41D 27/28 2/247
5,303,424 A * 4/1994 Cromartie ..... A41D 7/005 2/227
5,507,042 A * 4/1996 van der Slessen .... A41D 27/28 2/108
5,642,526 A * 7/1997 Thompson ..... A41D 13/02 2/69
5,704,064 A * 1/1998 van der Sleesen .... A41D 27/28 2/108
5,752,277 A * 5/1998 van der Sleesen .... A41D 27/28 2/108
D414,913 S * 10/1999 Katz ..... D2/829
6,085,353 A * 7/2000 van der Sleesen .... A41D 15/04 2/108
6,263,510 B1 * 7/2001 Bay ..... A41D 27/28 2/108
6,263,511 B1 * 7/2001 Moretti ..... A41D 27/28 2/410
6,332,221 B1 * 12/2001 Gracey ..... A41B 9/00 2/108
6,442,760 B2 * 9/2002 Moretti ..... A41D 27/28 2/115
6,823,678 B1 * 11/2004 Li ..... A41D 13/0025 62/259.3
7,111,328 B2 * 9/2006 Bay ..... A41D 3/00 2/86
7,169,249 B1 * 1/2007 Nordstrom ..... A41D 27/08 156/256
7,437,774 B2 * 10/2008 Baron ..... A41D 1/04 2/115
7,540,037 B1 * 6/2009 Bittler ..... A41D 13/0543 2/69
D620,231 S * 7/2010 Parker ..... D2/828
8,011,020 B2 * 9/2011 Vereen ..... A41B 1/08 2/108
8,453,264 B2 * 6/2013 Mickle ..... A41D 3/04 2/82
8,601,612 B2 * 12/2013 Funk-Danielson .... A45C 13/10 2/123
8,850,615 B2 * 10/2014 Demarest ..... A41D 27/28 2/69
9,119,429 B2 * 9/2015 Den Dekker ..... A41D 27/285
9,301,556 B2 * 4/2016 Koller ..... A41D 3/02
9,332,792 B2 * 5/2016 Harber ..... A41D 13/002
2003/0033656 A1 * 2/2003 Jaeger ..... A41D 27/28 2/69
2004/0237168 A1 * 12/2004 Braun ..... A41D 27/28 2/93
2005/0044607 A1 * 3/2005 van der Sleesen .... A41D 27/28 2/93
2006/0282940 A1 * 12/2006 Martini ..... A62B 17/006 2/455
2008/0196140 A1 * 8/2008 Mayerson ..... A41D 1/04 2/84
2008/0263743 A1 * 10/2008 Maurer ..... A41D 27/28 2/69
2009/0077710 A1 * 3/2009 Bay ..... A41D 27/28 2/87
2010/0299798 A1 * 12/2010 Fayle ..... A41D 27/10 2/69
2011/0099680 A1 * 5/2011 Gordon ..... A41D 27/28 2/79
2012/0047619 A1 * 3/2012 Lambertz ..... A41D 27/28 2/69
2012/0131720 A1 * 5/2012 Nordstrom ..... A41D 13/0015 2/69
2012/0233748 A1 * 9/2012 Curtis ..... A41D 13/00 2/455
2013/0031703 A1 * 2/2013 Curtis ..... A41D 31/0027 2/455
2013/0254969 A1 * 10/2013 Getzen ..... A41D 27/00 2/108
2013/0276201 A1 * 10/2013 Pezzimenti ..... A41D 13/002 2/69
2014/0000004 A1 * 1/2014 Baron ..... A41B 1/00 2/69
2014/0338091 A1 * 11/2014 Kenney ..... A41D 27/24 2/69
2016/0235147 A1 * 8/2016 Pezzimenti ..... A41D 27/28
2016/0242474 A1 * 8/2016 Baschak ..... A41D 13/0015
2017/0119073 A1 * 5/2017 Horner ..... A41D 27/10
2017/0215501 A1 * 8/2017 Horner ..... A41D 27/10

* cited by examiner

GARMENT, ESPECIALLY SPORTS GARMENT

The present application is a 371 of International application PCT/EP2014/000533, filed Mar. 1, 2014, the priority of this application is hereby claimed and this application is incorporated herein by reference.

BACKGROUND OF THE INVENTION

The invention relates to a garment, especially a sports garment, having a section which at least partially covers the body of a wearer, wherein the section has at least one venting element for allowing an air flow to flow from the outside of the garment through the section into the inner of the garment for cooling a part of the body of the wearer.

A garment of this kind is known from U.S. Pat. No. 5,704,064. It is beneficially—especially when the environment temperature is high—to take care for an air flow through the garment to establish comfortable thermal conditions for the wearer of the garment. Therefore, the garment is equipped with venting elements through which air can flow during the use of the jacket as described in the mentioned document.

Also, it is beneficial to establish sporting clothes with venting channels through which air can flow during sporting activities. It is detrimental that normally the required venting element are static, i. e. there is a certain opening at the surface of the garment (i. e. in the above mentioned section) which allows air to flow through the garment. While a big venting opening is beneficial during sporting activities this is not the case when the garment is not used for sports. Then, no venting opening is normally necessary.

SUMMARY OF THE INVENTION

Thus, it is an object of the invention to propose a garment of the generic kind which is optimized during sporting activities with respect to creating an air flow through the garment, but which has normal (venting free) properties in the case when no sports are done. Furthermore, the venting effect should be intensified during sporting activities. Thus, the cooling during the movement of the wearer of the garment should be improved.

The solution of this object according to the invention is characterized in that actuating means are arranged for opening and closing the venting element in dependence of the movement of a part of the body of the wearer during the use of the garment.

The actuating means can comprise a material section which is connected with a first end with the venting element and can be connected with a second end with a hand or foot of the wearer.

Preferably, the garment is a jacket or shirt, wherein the actuating means comprises at least a part of the arm sleeve of the jacket or shirt.

In this case the second end of the arm sleeve has preferably at least one opening for a thumb of the wearer. Preferably, a plurality of openings at the second end of the arm sleeve is provided, which are arranged in a distance to another along the longitudinal direction of the arm of the wearer. This distance is beneficially between 1 cm and 3 cm. A preferred embodiment of the invention comes up with three openings which are arranged at the second end of the arm sleeve. Preferably, the openings are arranged equidistantly from another.

At least the arm sleeves of the jacket or shirt and preferably the whole jacket or shirt is close-fitting to the body of the wearer.

The venting element can be established by two adjacent edges of the section which are contacting in a closed state and which are gaping in an open state. Then, at least one of the edges can contain a stiffening element or is made of a stiff material.

The stiffness of the two adjacent edges is thereby preferably different. One of the edges can be connected with the actuating means. The stiffness of the edges which are connected with the actuating means is preferably higher than the stiffness of the edge which is not connected with the actuating means. The edge with the lower stiffness can have at least one indentation to reduce the stiffness.

Preferably, two venting elements are arranged symmetrically in the spine region or in the scapula region of the garment, wherein preferably the two venting elements are arranged in an upper region of the garment.

By the proposed design of a garment a beneficial air flow is generated in those times in which it is necessary, i. e. during sporting activities.

Thereby, it is very beneficial that the tension-transferring actuating means affect one of the edges of the venting element perpendicular to the edge which has in general beneficially a longitudinal extension. So, a perpendicularity of the venting elements with regards to the tension lines (of the actuation means) generated when a wearer swings his arms backwards and forwards is given, e. g. during running.

Beneficially, the stiffness relationship between one of the flaps (upper flap corresponding to one of the edges) of the venting element and the other flap (lower flap corresponding to the other edge) is given. The upper flap has preferably a higher stiffness as to force it to "pop" open when a perpendicular force is applied, while the lower flap is preferably designed with specific indentations to reduce its stiffness, hence allowing for it not to "pop" when force is applied. This difference in stiffness allows the venting element to open easily.

The opening of the venting elements (back vents) takes place via a textile panel which extends from a thumbhole (above mentioned opening) to the actual venting element which is placed preferably on top of the scapula. This connection allows for a direct transfer of the pulling force when the wearer swings his arm forward, i. e. increasing the tension on said textile panel. This textile panel should use material which allows a certain stretch as to account for user conformability.

The adjustable thumbhole is a further beneficial feature. This feature allows an adaption to different user preferences, different arm lengths and/or different running styles with respect to the generated tension in the actuating means to be applied to open the vents. It consists preferably of three consecutive openings separated by about 2 cm along the longitudinal axis of the garment sleeve and finishing at the sleeves cuff.

Thus, the cooling is achieved and/or supported by enabling an increased convection effect on the wearer's skin via the described venting mechanism.

In the drawings an embodiment of the invention is shown.

DETAILED DESCRIPTION OF THE INVENTION

Figure 2:
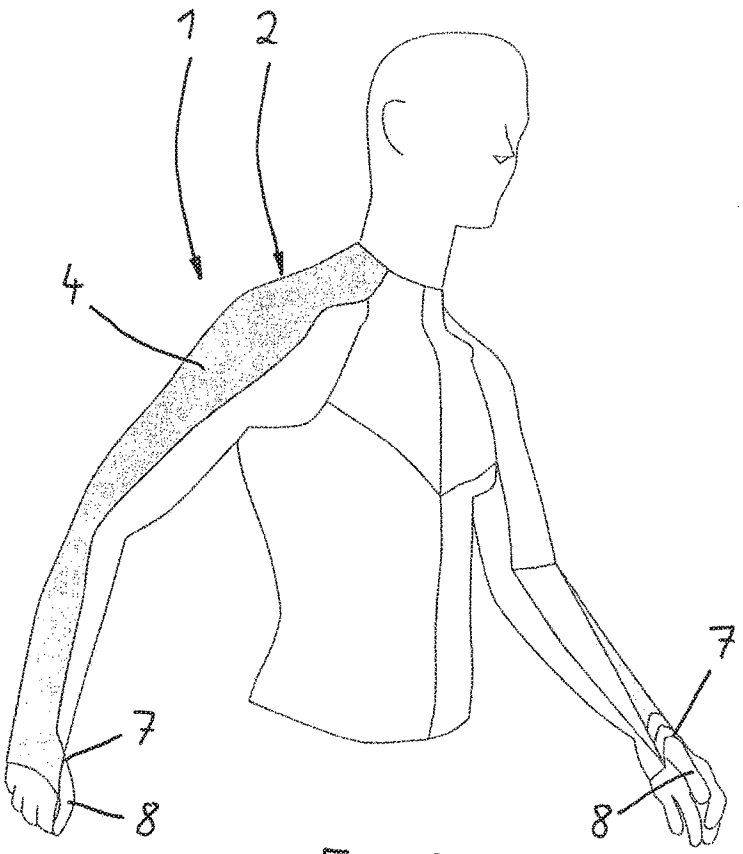
FIG. 2 shows a lateral view of a wearer wearing the sports garment according to FIG. 1.
Figure 1:
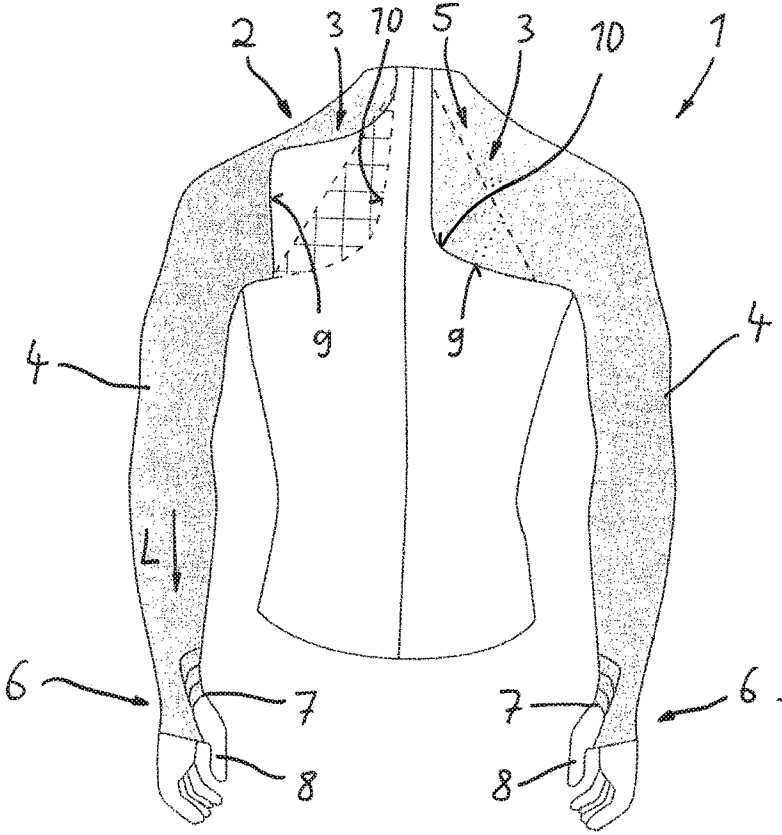
FIG. 1 shows the front view of a sports garment being a jacket, where the hands of a wearer are also depicted.
Figure 3:
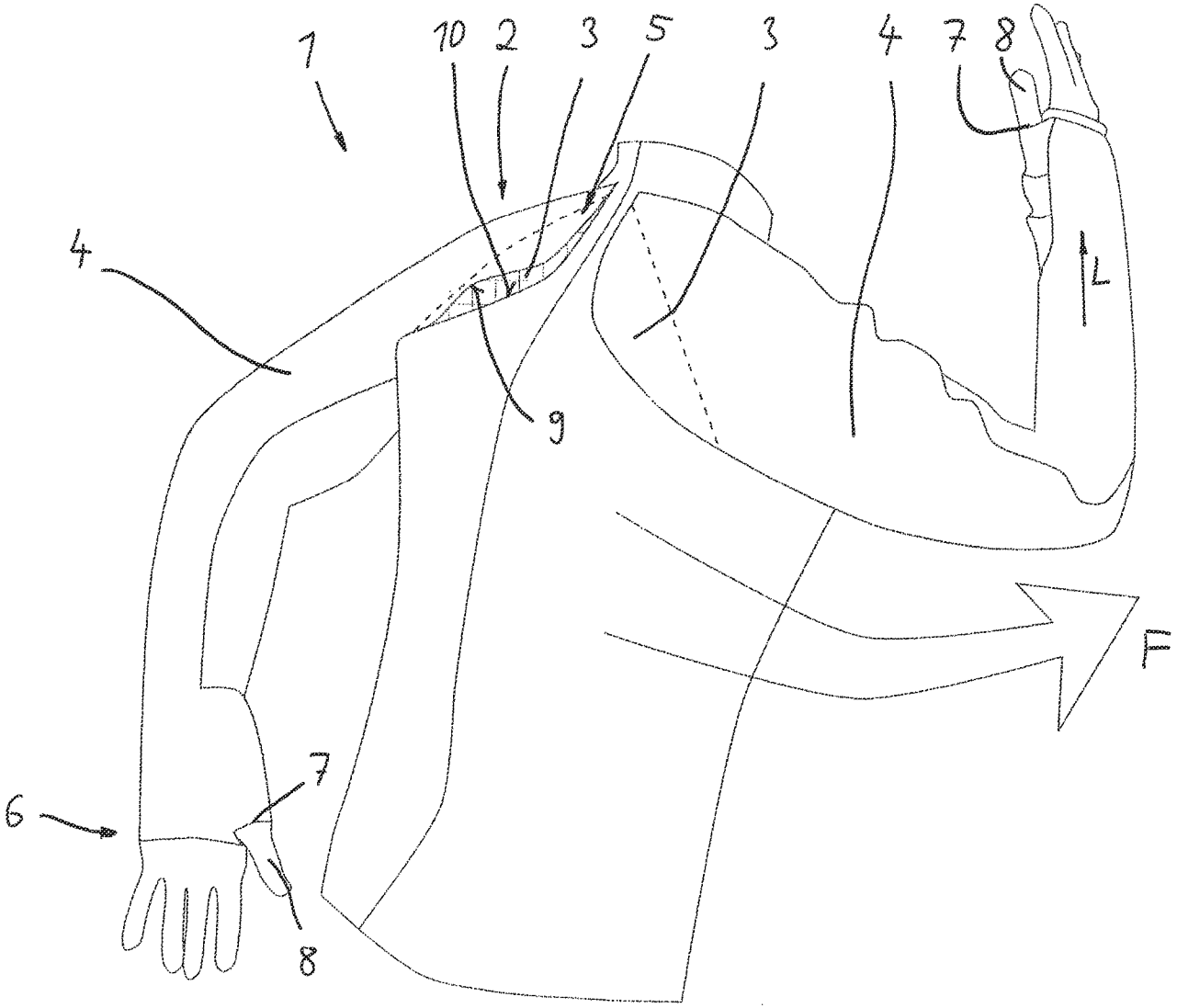
FIG. 3 shows a lateral view of a wearer wearing the sports garment carrying out an arm movement during running and FIG. 4 shows the side view of the hand of the wearer with a part of the garment.

In the FIGS. 1 to 4 a garment 1 is shown which is a sports jacket. It covers a part of a wearer in known manner. The garment 1 covers the wearer by a section 2 of the garment. As can be seen in FIG. 1 two venting elements 3 are arranged in the scapula region of the jacket, i. e. on the reverse side of the garment, which are arranged in the mentioned section 2 of the garment 1.

The venting element 3 is defined substantially by two edges 9 and 10. The two edges 9, 10 can be in an adjoining position; in this position the venting element 3 is closed. Also they can be in a gaping position; i. e. in this position the two edges 9, 10 are drawn away from another and form an opening between them. In FIG. 1 in the right half of the sketch it is shown the closed position of the venting element, while in the left half of the sketch the opened position is depicted. In this position an air flow F can flow through the garment, schematically shown in FIG. 3.

The opening and closing of the venting elements 3—i. e. the relative movement between the two edges 9 and 10—is controlled by actuating means 4. Those actuating means 4 are established by the arm sleeves of the garment 1. The arm sleeve has a first end 5 terminating in the region of the venting element 3 and being connected with the edge 9. Furthermore, the arm sleeve has a second end 6 terminating in the region of the hand of the wearer.

Figure 4:
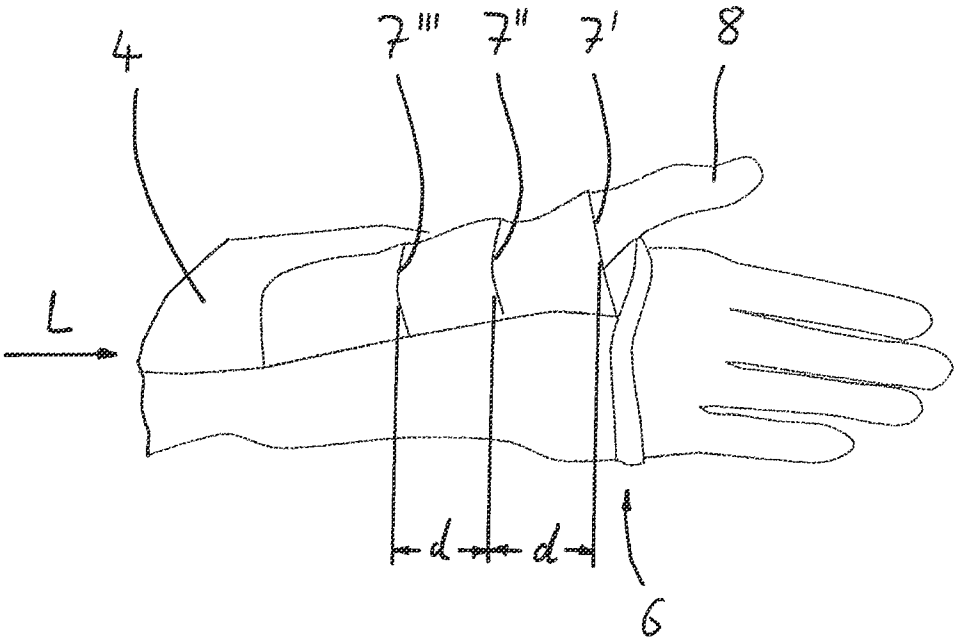

During a stride of the wearer an arm swings forward and thus the arm sleeve is acting as an actuating means 4, because the arm sleeve is connected with the hand of the wearer as shown specifically in FIG. 4. Here, it can be seen that the arm sleeve has three openings 7', 7" and 7'" in the region of the second end 6. The thumb 8 of the wearer can reach through one of the openings—in the depicted embodiment according FIG. 4 the thumb 8 reaches through the first one of the three openings 7'.

So, a forward movement of the arm takes with it the second end 6 of the arm sleeve 4. Because the arm sleeve 4 is made of a material with the ability to transfer tensions, the movement of the second end 6 is transferred to the first end 5 which in turn pulls the edges 9 away from the edges 10 and opens the venting element 3.

As can be seen in FIG. 4 the openings 7', 7", 7'" are spaced apart in longitudinal direction L by the distances d. Those distances are about 2 cm. That is, a wearer can select the most suitable opening 7', 7", 7'" to guide his thumb 8 through the respective opening to adjust the described effect according to a desired level.

Accordingly, the actuating means 4 are arranged for opening and closing of the venting element 3 in dependence of the movement of the arms of the wearer.

In the embodiment it is shown that two venting element 3 are provided in the scapula region of the garment 1 and symmetrically to a media plane. Of course, also more than two venting elements 3 can be provided.

The garment 1 consists at least with respect to the arm sleeves of an elastic material which can duly transfer a longitudinal tension from the hand of the wearer to the venting element and more specifically to the edge 9. Beneficially, as shown, the textile material from the hand to the edge 9 ends perpendicularly in the edge 9, i. e. the longitudinal axis of the textile material from the hand of the wearer to the edge 9 is perpendicular to the slit configuration (see right hand side in FIG. 1) of the two edges 9, 10 which forms the opening of the venting element 3.

The venting element 3 can adjoin to a flow channel for air (not depicted) in the inner of the garment 1. The flow channel can deliver the air to a desired region in the inner of the garment 1.

REFERENCE NUMERALS

1 Garment
2 Section
3 Venting element
4 Actuating means
5 First end
6 Second end
7 Opening
7' Opening
7" Opening
7'" Opening
8 Thumb
9 Edges
10 Edge
F Air flow
d Distance
L Longitudinal direction

The invention claimed is:

1. A garment, wherein the garment is a jacket or shirt having:

a section configured to at least partially cover the body of a wearer, wherein the section has at least one venting element for allowing an air flow to flow from the outside of the garment through the section into the inner of the garment for cooling a part of the body of the wearer, wherein the venting element is arranged in a spine region or a scapula region of the garment, an arm sleeve extending in a longitudinal direction from a shoulder area of the garment to a distal end with a distal end opening through which a hand of a user can extend, and actuating means configured to open and close the venting element in dependence of a movement of a part of the body of the wearer during the use of the garment, wherein the actuating means comprise a material section having a first end connected to the venting element and a second end connected to a plurality of actuating openings disposed at the distal end of the arm sleeve, the plurality of actuating openings are arranged at a distance from one another in the longitudinal direction of the arm sleeve, wherein the distance between each adjacent pair of the actuating openings is in the range of 1 cm to 3 cm so that a thumb of the wearer is receivable in one of the actuating openings, the actuating means is configured to establish a connection to the thumb of the user by the one of the actuating openings when the thumb of the wearer is received in the one of the actuating openings and to allow a transfer of tension via the material section along the longitudinal direction of the arm sleeve from the one of the actuating openings at the distal end to the venting element to open the venting element during a forward swinging movement of the sleeve relative to the garment by the wearer.

2. The garment according to claim 1, wherein the plurality of actuating openings includes three openings.

3. The garment according to claim 1, wherein at least the arm sleeves of the jacket or shirt are configured to be close-fitting to the body of the wearer.

4. The garment according to claim 1, wherein the venting element includes a first flap of the garment and a second flap of the garment, wherein edges of the first flap and the second flap are contacting in a closed state of the venting element and are gaping in an open state of the venting element.

5. The garment according to claim 4, wherein at least one of the edges contains a stiffening element or is made of a stiff material, the stiffening element or the stiff material has a stiffness that is greater than a remainder of the first flap and the second flap.

6. The garment according to claim 4, wherein the stiffness of the edges is different.

7. The garment according to claim 4, wherein one of the edges is connected with the actuating means.

8. The garment according to claim 7, wherein the stiffness of the one of the edges connected with the actuating means is greater than the stiffness of the other of the edges which is not connected with the actuating means.

9. The garment according to claim 6, wherein the other of the edges with the lower stiffness has at least one indentation to reduce the stiffness.

10. The garment according to claim 1, wherein the at least one venting element includes two venting elements arranged symmetrically in the spine region or in the scapula region of the garment.

* * * * *